US006802740B1

(12) United States Patent
Fan et al.

(10) Patent No.: US 6,802,740 B1
(45) Date of Patent: Oct. 12, 2004

(54) CABLE CONNECTOR ASSEMBLY HAVING GROUNDING DEVICES

(75) Inventors: MonHua Fan, Kunsan (CN); Telen Wang, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/465,288

(22) Filed: Jun. 18, 2003

(30) Foreign Application Priority Data

Apr. 9, 2003 (TW) ..... 92205564 U

(51) Int. Cl.[7] ..... H01R 13/648
(52) U.S. Cl. ..... 439/607; 439/937
(58) Field of Search ..... 439/95, 564, 607, 439/609, 939

(56) References Cited

U.S. PATENT DOCUMENTS 5,709,569 A * 1/1998 Buck et al. ..... 439/607
6,206,731 B1 * 3/2001 Kuo ..... 439/610
6,231,383 B1 * 5/2001 Hwang ..... 439/545
6,347,948 B1 * 2/2002 Hwang ..... 439/92

* cited by examiner

*Primary Examiner*—Thanh-Tam Le
(74) *Attorney, Agent, or Firm*—Wei Te Chung

(57) ABSTRACT

A cable connector assembly (1) includes an electrical connector (20) having a metallic shell (21), a cable (60) electrically connecting with the electrical connector, an insulative enclosure (10) having a mounting face (101) and surrounding the electrical connector and the cable with the metallic shell partially extending beyond the mounting face, at least one mounting member (30) located in the insulative enclosure and being on one side of the electrical connector, a conductor (50) having two ends soldered with the metallic shell and mounting member respectively, and at least one fastener (40) used to engage with the mounting member for retaining the cable connector assembly to a grounding panel (70) and electrically connecting the mounting member and the grounding panel.

5 Claims, 4 Drawing Sheets

CABLE CONNECTOR ASSEMBLY HAVING GROUNDING DEVICES

BACKGROUND OF THE INVENTION

1. Field of the Invention

The present invention relates to a cable connector assembly, and particularly to a cable connector assembly having improved grounding devices.

2. Description of Related Art

A conventional cable connector assembly usually comprises a cable and an electrical connector connected to an end of the cable. The electrical connector generally comprises a metallic shell. When the assembly is mounted to a grounding panel of a computer enclosure, the metallic shell electrically contacts the grounding panel to provide ESD (Electro-Static Discharge) and EMI (Electro-Magnetic Interference) protection.

U.S. Pat. No. 6,210,216 discloses a cable connector assembly comprising a conductive plate. The conductive plate has a first section overlapping an outside surface of a front wall of a casing of the cable connector assembly and a second section resiliently abutting against a metallic shell of an electrical connector of the cable connector assembly. When the cable connector assembly is secured to a grounding panel with the front wall of the casing surfacely contacting with the grounding panel and a mating port of the electrical connector partially extending beyond the grounding panel, the first section of the conductive plate electrically engages with the grounding panel to establish an electrical connection between the grounding panel and the metallic shell of the electrical connector.

However, the grounding devices of the mentioned patent is complicated and an additional mold is needed to form the conductive plate. And sometimes, the dimensions of the mating port and a part thereof which is exposed outside the grounding panel are fixed to comply with specific applied environment. The first section overlapping the front wall of the casing will change the dimension of the part of the mating port which is exposed outside the grounding panel, so the cable connector assembly is required to be renewed. Hence, a cable connector assembly having improved grounding devices is desired.

SUMMARY OF THE INVENTION

An object of the present invention is to provide a cable connector assembly comprising a grounding device having a simple structure for being easy to manufacture.

Another object of the present invention is to provide a cable connector assembly comprising a grounding device which will not change the dimensions of the cable connector assembly.

To achieve the above objects, a cable connector assembly in accordance with the present invention comprises an electrical connector comprising a metallic shell, a cable electrically connecting with the electrical connector, an insulative enclosure having a mounting face and surrounding the electrical connector and the cable with the metallic shell partially extending beyond the mounting face, at least one mounting member located in the insulative enclosure and being on one side of the electrical connector, a conductor having two ends soldered with the metallic shell and mounting member respectively, and at least one fastener used to engage with the mounting member for retaining the cable connector assembly to a grounding panel and electrically connecting the mounting member and the grounding panel.

Other objects, advantages and novel features of the invention will become more apparent from the following detailed description when taken in conjunction with the accompanying drawings.

DETAILED DESCRIPTION OF THE INVENTION

Figure 1:
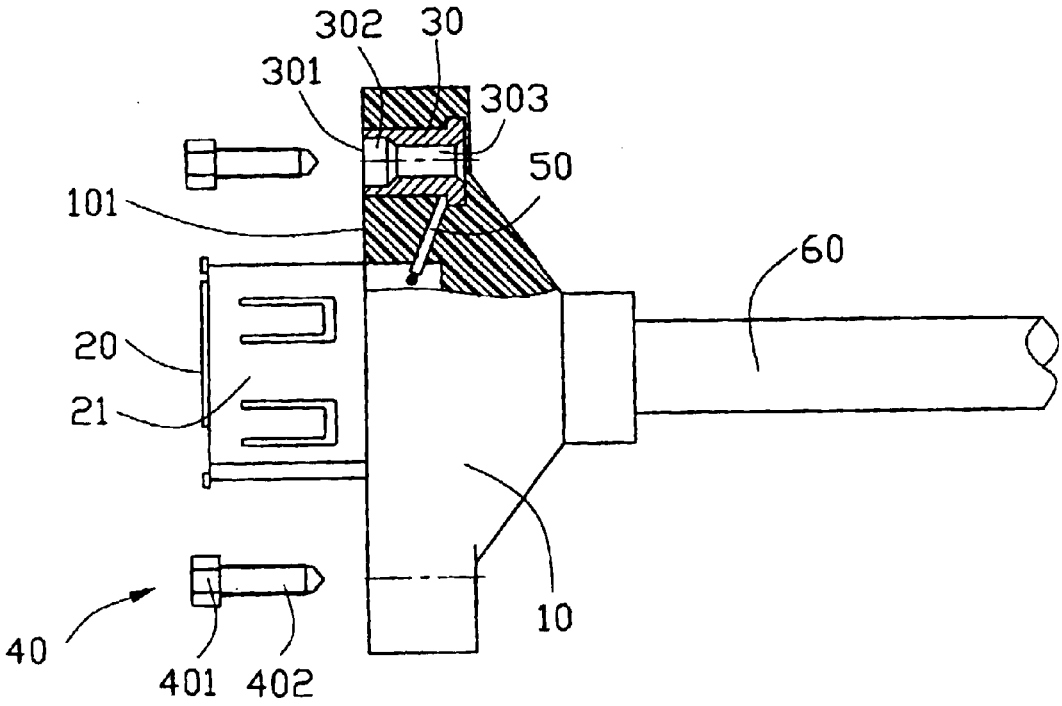
FIG. 1 is a partially cross-sectional view of a cable connector assembly in accordance with the present invention, but fasteners thereof are disengaged from mounting members thereof.
Figure 2:
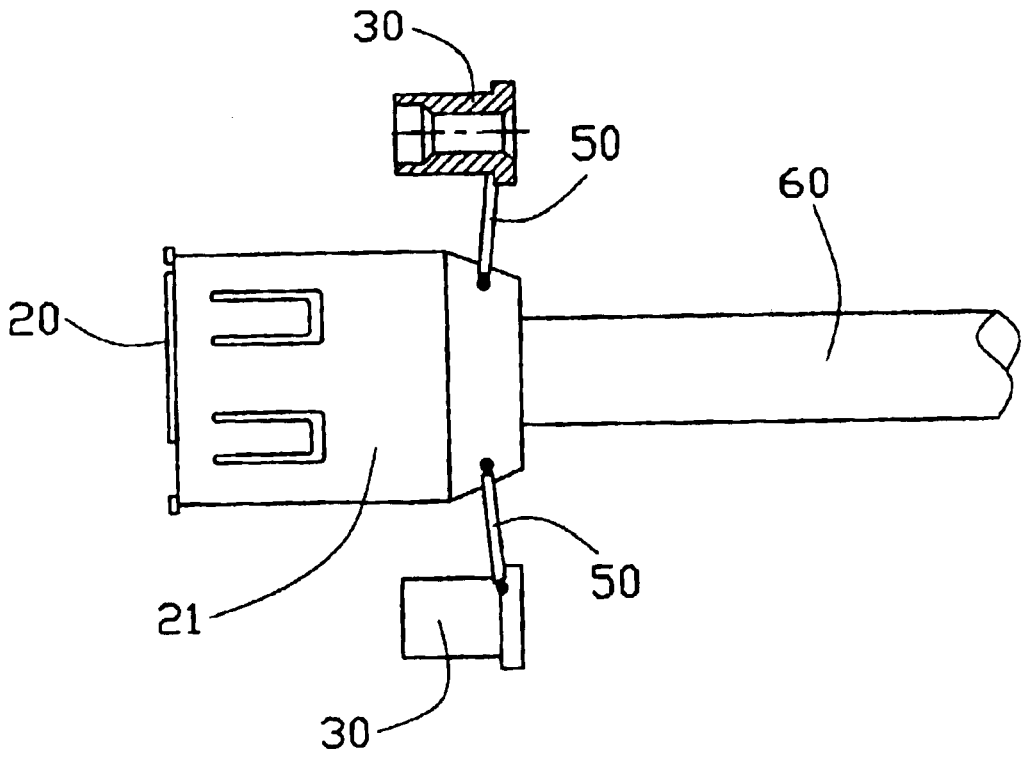
FIG. 2 is a view similar to FIG. 1 but the fasteners and an insulative enclosure of the cable connector assembly have been taken away.
Figure 3:
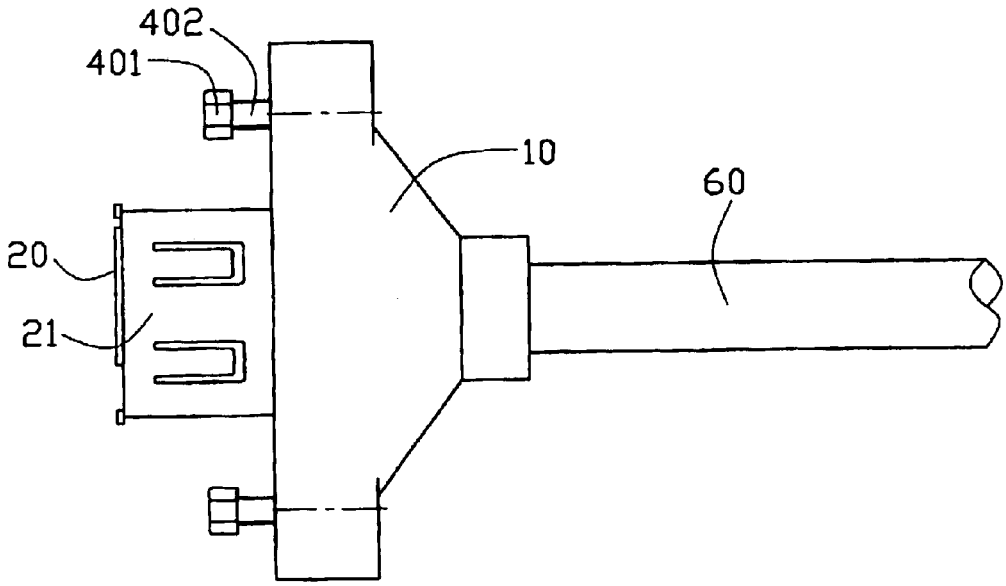
FIG. 3 is a top view of the cable connector assembly of FIG. 1.

Referring to FIGS. 1, 2, and 3, a cable connector assembly 1 in accordance with the present invention comprises an insulative enclosure 10, an electrical connector 20, a pair of mounting members 30, a pair of fasteners 40, a pair of conductors 50 and a cable 60.

The electrical connector 20 is an IEEE (Institute of Electric Engineers) 1394 connector comprising an insulative housing (not shown), a plurality of terminals (not shown) received in the insulative housing, and a metallic shell 21 enclosing the insulative housing. The terminals are soldered to wires (not shown) of the cable 60 in ways known to persons skilled in the pertinent art.

The mounting members 30 are a pair of metallic nuts located on two opposite sides of the electrical connector 20. Each metallic nut has a front face 301 defining a clear hole 302 and a screw hole 303 communicating the clear hole 302. The clear hole 302 and the screw hole 303 have a same axis and the diameter of the clear hole 302 is larger than the diameter of the screw hole 303. Two ends of each conductor 50 are soldered to one nut 30 and the metallic shell 21 of the electrical connector 20 respectively, thereby electrically connecting the nuts 30 and the metallic shell 21. The conductors 50 are wires in this embodiment. It is to be understood, the conductors 50 can be metallic bars or in any other possible configurations known to one of ordinary skill in the pertinent art.

The insulative enclosure 10 embeds the ends of the electrical connector 20, cable 60, the mounting members 30 and the conductors 50 therein, and has a mounting face 101. The metallic shell 21 extends forwardly partially beyond the mounting face 101 of the insulative enclosure 10 to mate with the complementary connector (not shown). The front faces 301 of the nuts 30 are substantially flush with the mounting face 101 of the insulative enclosure 10.

The fasteners 40 are a pair of metallic bolts. Each metallic bolt 40 has a cap portion 401 and a screw post 402 extending from the cap portion 401.

Figure 4:
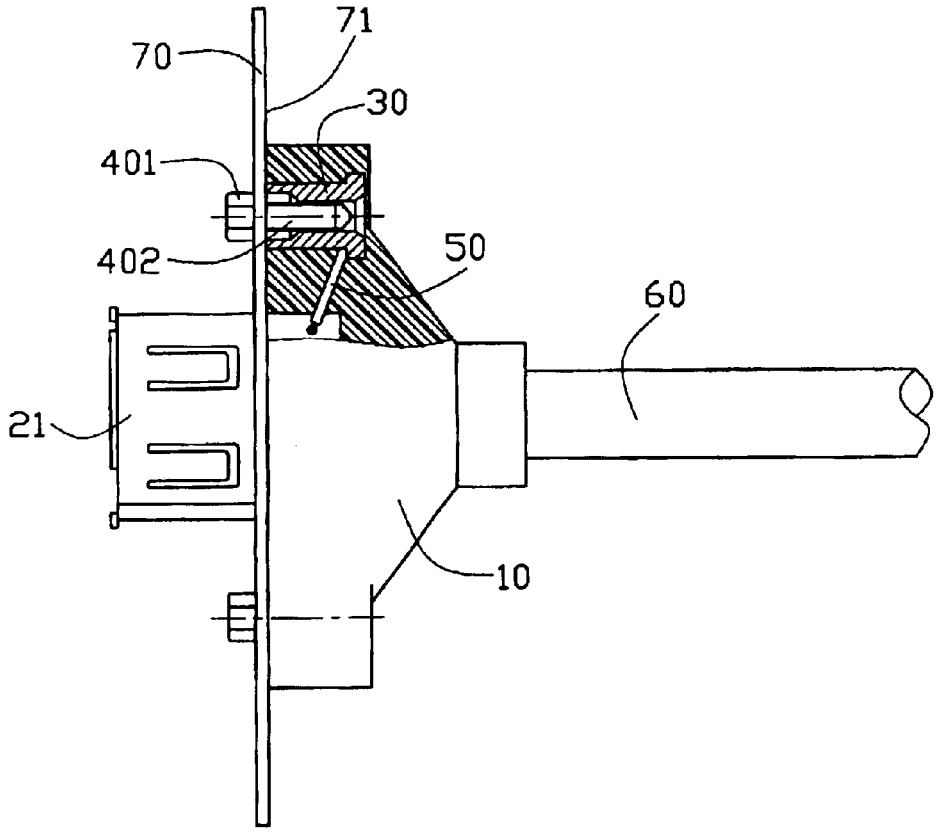
FIG. 4 is a view similar to FIG. 3 but the cable connector assembly has been retained to a grounding panel.

Referring to FIG. 4, when the cable connector assembly 1 is assembled to a grounding panel 70 having a engaging face 71. The metallic shell 21 of the electrical connector 20 extends through an opening (not shown) of the grounding panel 70. The mounting face 101 of the insulative enclosure 10 abuts against the engaging face 71 of the grounding panel 70. The screw posts 402 of the metallic bolts 40 extend through corresponding hole (not shown) of the grounding panel 70 and engage with the screw holes 303 of the nuts 30 to retain the cable connector assembly 1 to the grounding panel 70. Since the grounding panel 70 is clamped between the mounting face 101 of the insulative enclosure 10 and the cap portions 401 of the bolts 40, the front faces 301 of the nuts 30 and the cap portions 401 of the bolts 40 firmly abut against the grounding panel 70 to electrically connect the nuts 30, the bolts 40 and the grounding panel 70. So the metallic shell 21 of the electrical connector 20 electrically connects the grounding panel 70 reliably.

It is to be understood, however, that even though numerous characteristics and advantages of the present invention have been set forth in the forgoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly for being mounted to a grounding panel, comprising:

an electrical connector comprising a metallic shell;

a cable electrically connecting with the electrical connector;

an insulative enclosure surrounding the electrical connector and the cable;

a mounting member located in the insulative enclosure and on one side of the electrical connector;

a conductor soldered to the metallic shell and the mounting member respectively for electrically connecting the metallic shell and the mounting member; and a fastener engaged with the mounting member and electrically connecting with the metallic shell by way of the mounting member and the conductor;

wherein the mounting member is a metallic nut;

wherein the fastener is a metallic bolt;

wherein the fastener attaches to the corresponding mounting member and abuts against the grounding panel, the fastener and the mounting member being located by opposite sides of the grounding panel;

wherein the conductor is a wire;

wherein the conductor is protectively embedded in the insulative enclosure; and wherein the grounding panel, against which the insulative enclosure abuts and from which a front portion of the metallic shell forwardly extend.

2. The cable connector assembly as claimed in claim 1, wherein the insulative enclosure has a mounting face, and wherein the metallic shell of the electrical connector extends partially beyond the mounting face of the insulative enclosure.

3. The cable connector assembly as claimed in claim 1 further comprising a second mounting member located in the insulative enclosure on an opposite side of the electrical connector.

4. The cable connector assembly as claimed in claim 3 further comprising a second conductor soldered to the metallic shell and the second mounting member respectively.

5. The cable connector assembly as claimed in claim 4 further comprising a second fastener engaged with the second mounting member and electrically connecting with the metallic shell by way of the second mounting member and the second conductor.

* * * * *